US007021398B1

(12) United States Patent
Marshall

(10) Patent No.: US 7,021,398 B1
(45) Date of Patent: Apr. 4, 2006

(54) BOX SCRAPER ASSEMBLY

(76) Inventor: Lorry L. Marshall, 371 Road 3168, Hastings, NE (US) 68901

( * ) Notice: Subject to any disclaimer, the term of this patent is extended or adjusted under 35 U.S.C. 154(b) by 0 days.

(21) Appl. No.: 11/031,577

(22) Filed: Jan. 6, 2005

(51) Int. Cl.
*E02F 3/12* (2006.01)
*E02F 3/64* (2006.01)
*E02F 3/76* (2006.01)

(52) U.S. Cl. ..... 172/788; 172/789; 172/791; 172/796; 172/797; 172/824; 172/830

(58) Field of Classification Search ..... 172/779–799.5, 172/197, 199, 200, 810, 811, 818–832, 684.5
See application file for complete search history.

(56) References Cited

U.S. PATENT DOCUMENTS

| | | | | |
|---|---|---|---|---|
| 4,061,194 | A | 12/1977 | McCanse | 172/447 |
| 4,189,009 | A | 2/1980 | Welch | 172/384 |
| 6,168,348 | B1 | 1/2001 | Meyer et al. | 404/90 |

*Primary Examiner*—Christopher J. Novosad
(74) *Attorney, Agent, or Firm*—Thomte, Mazour & Niebergall; Dennis L. Thomte

(57) ABSTRACT

A box scraper attachment is provided for mounting on the boom arms of a skid-steer vehicle or the like. The box scraper attachment includes a main frame having castor wheel assemblies mounted at the forward end thereof. A box scraper is selectively vertically movably secured to the main frame and is selectively pivotally movably secured to the main frame.

3 Claims, 6 Drawing Sheets

BOX SCRAPER ASSEMBLY

BACKGROUND OF THE INVENTION

1. Field of the Invention

This invention relates to a box scraper assembly and more particularly to a box scraper assembly which is mounted on the forward ends of the boom arms of a skid-steer vehicle or the like.

2. Description of the Related Art

Box scrapers are commonly secured to the forward or rearward ends of a tractor or skid-steer vehicle to enable soil to be leveled or graded. For example, in U.S. Pat. No. 6,168,348, a box scraper is mounted on the forward ends of the boom arms of a skid-steer tractor with the boom arms being raised or lowered to raise and lower the box scraper. The box scraper of U.S. Pat. No. 6,168,348 does not have the ability to tilt or pivot about a longitudinal axis with respect to the vehicle which means that the box scraper will be disposed at the same angle as the angular attitude of the vehicle. In other words, if the front wheels of the vehicle are positioned on a 15° side slope, the attitude of the box scraper will also be disposed at a 15° angle with respect to horizontal.

SUMMARY OF THE INVENTION

A box scraper is provided for use with a skid-steer loader or the like. The box scraper of this invention comprises a main frame, the rearward end of which is selectively removably secured to the forward ends of the boom arms of the vehicle. A castor wheel support is pivotally secured to the forward end of the main frame and has a pair of spaced-apart castor wheels secured thereto. A transversely extending box scraper is selectively vertically movably mounted and selectively pivotally movably mounted on the main frame. The box scraper is pivotally secured to the main frame about a longitudinally extending axis so that the box scraper may be tilted or pivoted with respect to the main frame by means of hydraulic cylinders. The box scraper also has a hydraulic cylinder connected thereto for selectively raising or selectively lowering the box scraper with respect to the main frame. The tilted orientation of the box scraper does not change as the box scraper is raised or lowered.

It is therefore a principal object of the invention to provide an improved box scraper assembly which is selectively removably positioned on the forward ends of boom arms of a skid-steer vehicle or the like.

Still another object of the invention is to provide a box scraper assembly including means for tilting or pivotally moving the box scraper, about a longitudinal axis, to enable the box scraper to be selectively moved to the desired angular relationship regardless of the grade of the soil being scraped or leveled.

Still another object of the invention is to provide a box scraper assembly including a box scraper which is selectively vertically movably mounted and selectively pivotally movably mounted with respect to a main frame.

Still another object of the invention is to provide a box scraper assembly of the type described wherein the angular attitude of the box scraper with respect to horizontal will not change as the box scraper is moved upwardly or downwardly with respect to the main frame.

These and other objects will be apparent to those skilled in the art.

DETAILED DESCRIPTION OF THE INVENTION

Figure 1:
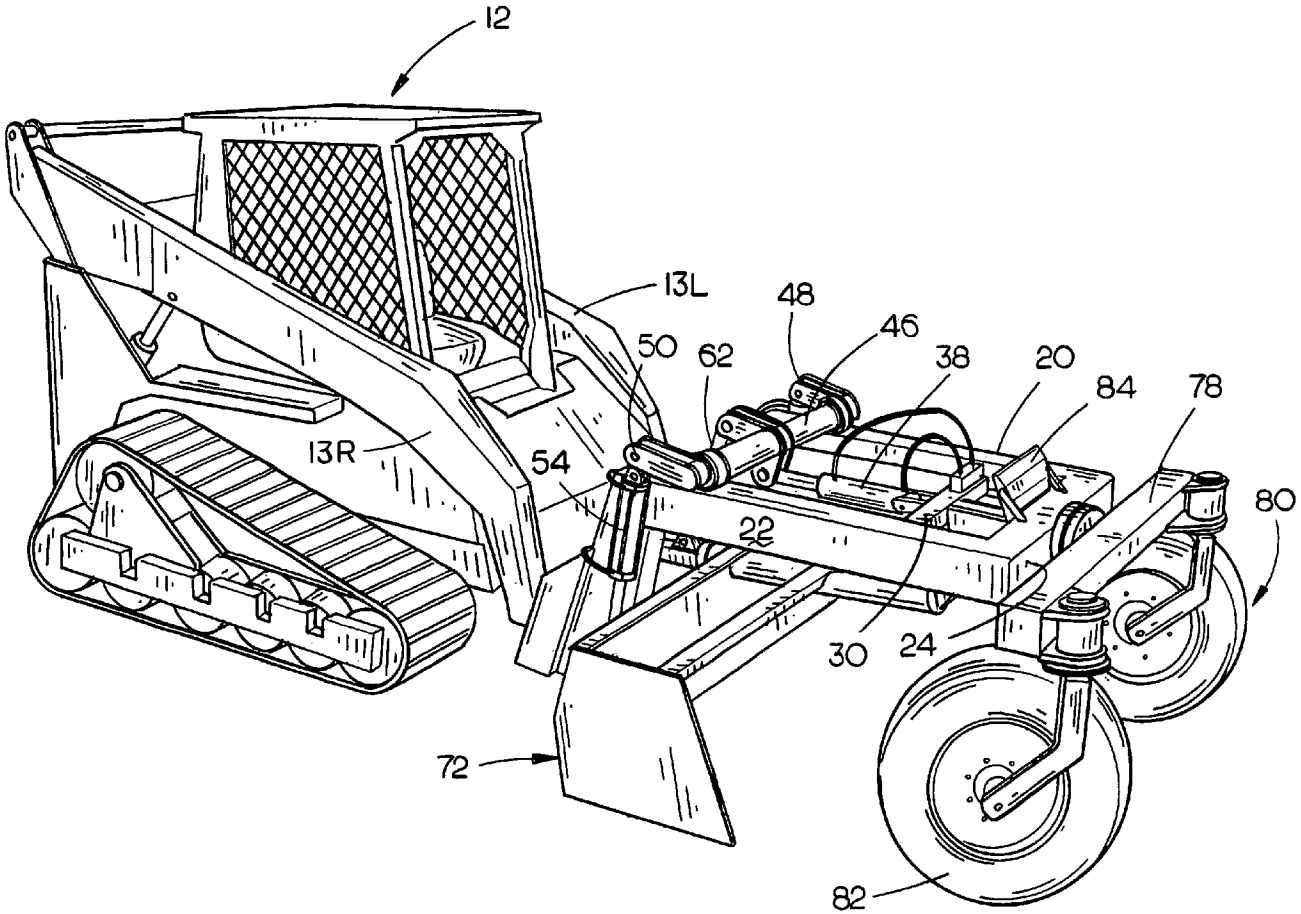
FIG. 1 is a perspective view of the box scraper assembly of this invention mounted on a skid steer vehicle.

The box scraper assembly of this invention is referred to generally by the reference numeral 10 and which is designed so as to be selectively removably secured to the forwardly extending boom arms of a skid-steer vehicle 12 of conventional design. The boom arms 13R and 13L of the vehicle 12 have conventional male quick-attach means 26 at the forward ends adapted to be inserted into conventional female quick-attach receptacles 28 provided at the rear end of the box scraper assembly 10 as will be described in more detail hereinafter.

Box scraper assembly 10 includes a main frame 14 having a pair of spaced-apart upstanding frame members 16 and 18, the upper ends of which are secured to longitudinally extending frame members 20 and 22, respectively. A transversely extending frame member 24 is secured to and extends between the forward ends of frame members 20 and 22. The lower rearward ends of frame members 16 and 18 each have the rearwardly presented female quick-attach receptacle 28 of conventional design provided thereon adapted to receive the male quick-attach members 26 mounted on the forward ends of the boom arms 13R and 13L of the vehicle 12. Main frame 14 also includes a transversely extending frame member 30 which is secured to frame members 20 and 22 and which extends therebetween rearwardly of the forward ends thereof. A pair of spaced-apart brackets or plates 32 and 34 are secured to the rearward side of frame member 24 and extend downwardly therefrom. The forward end of brace or frame member 36 is secured to brackets 32 and 34 and is secured at its rearward end to the forward side of frame member 30. The forward (base) end of hydraulic cylinder 38 is secured to the rearward side of frame member 30 and extends rearwardly therefrom.

The forward end of an angular support bar 40 is selectively vertically adjustably secured to brackets 32 and 34. A pair of collars or sleeves 42 and 44 are welded to the upper ends of frame members 20 and 22 near the rearward ends thereof, respectively. An elongated tube or pipe 46 is rotatably mounted in collars 42 and 44 so that the ends thereof are positioned outwardly of frame members 20 and 22. Brackets 48 and 50 are welded to the opposite ends of tube 46 and extend transversely therefrom. The upper (base) ends of hydraulic cylinders 52 and 54 are pivotally secured to the ends of brackets 48 and 50, respectively. Bracket 56 is welded to tube 46 between collars 42 and 44 and includes end portions 58 and 60. End portion 58 of bracket 56 is pivotally secured to the rod of hydraulic cylinder 38 so that extension of the hydraulic cylinder 38 will cause tube 46 to rotate in a counterclockwise direction (as viewed from the left side of assembly 10). Retraction of hydraulic cylinder 38 will cause tube 46 to rotate in a clockwise direction (as viewed from the left side of assembly 10).

Figure 2:
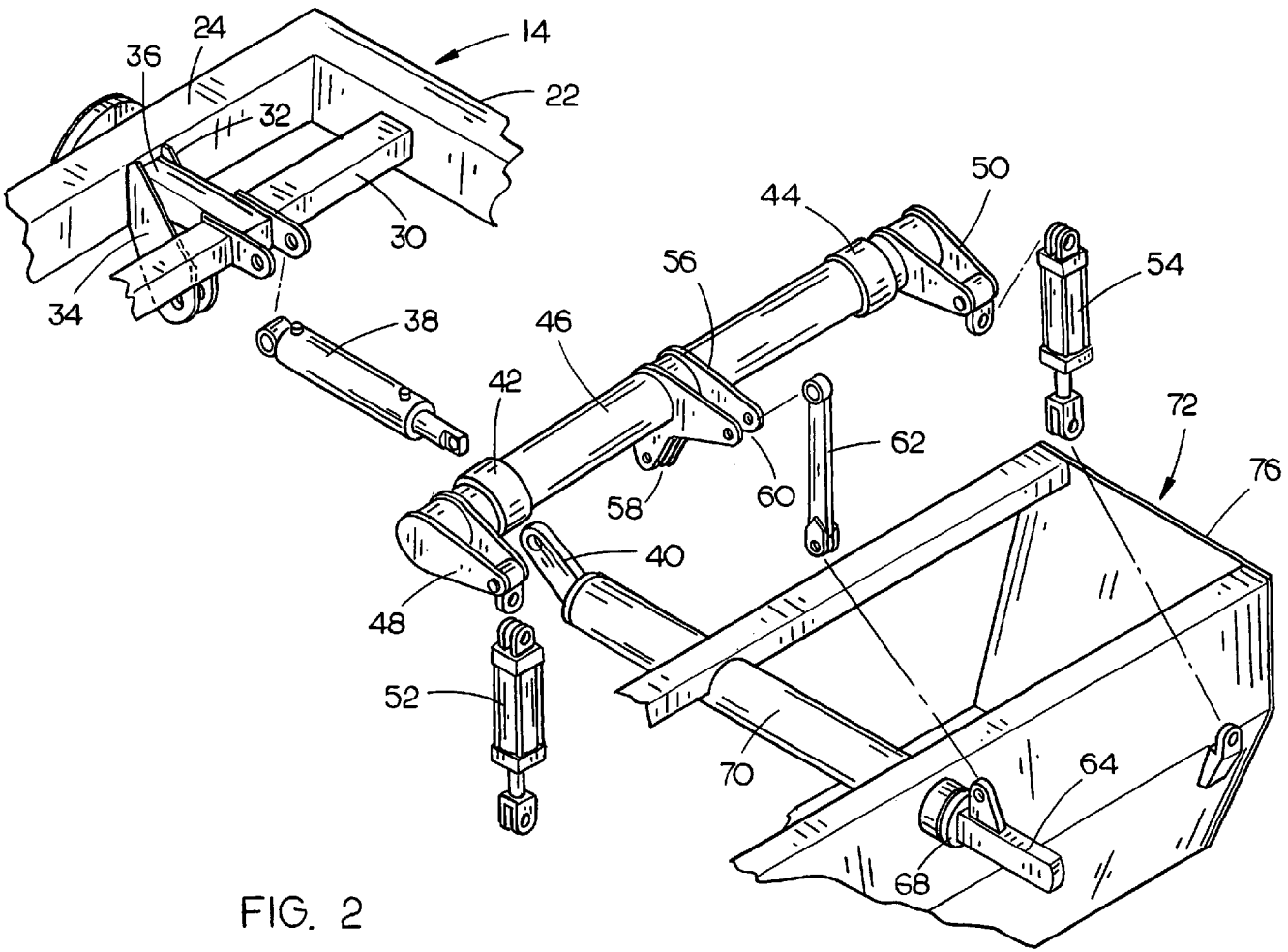
FIG. 2 is a partial exploded perspective view of the invention.
Figure 3:
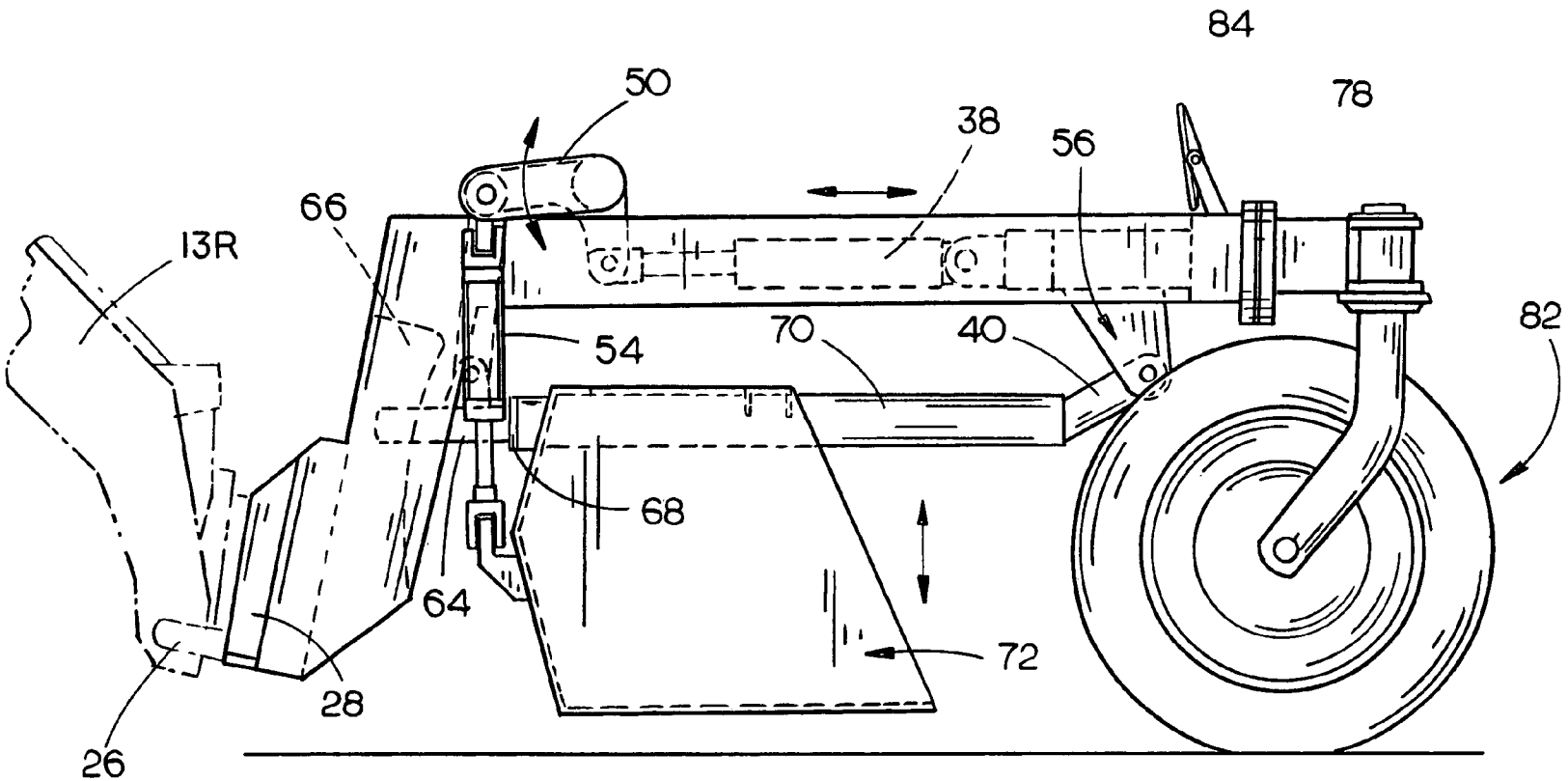
FIG. 3 is a side elevational view of the invention.
Figure 4:
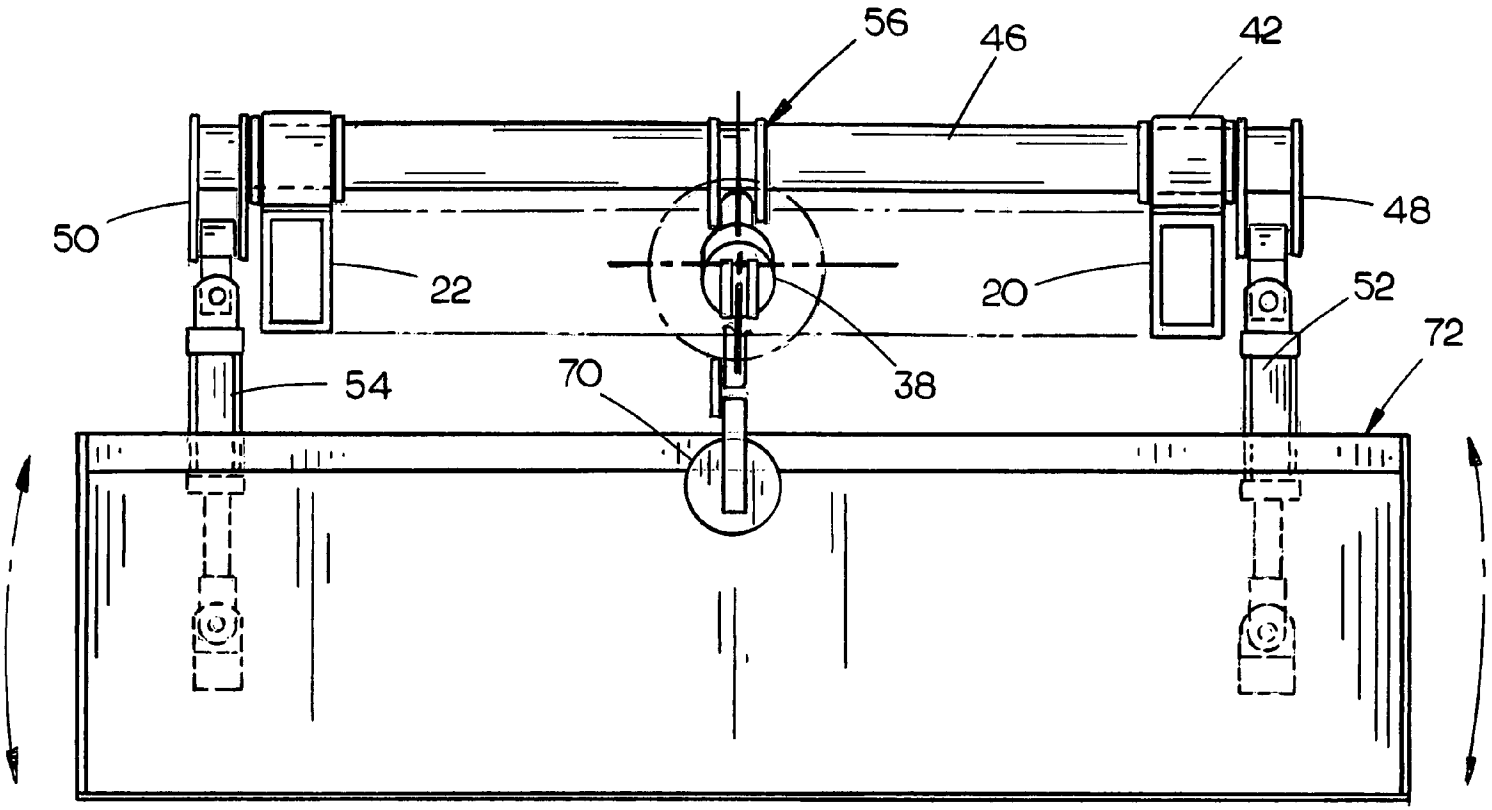
FIG. 4 is a partial front elevational view of the invention.
Figure 5:
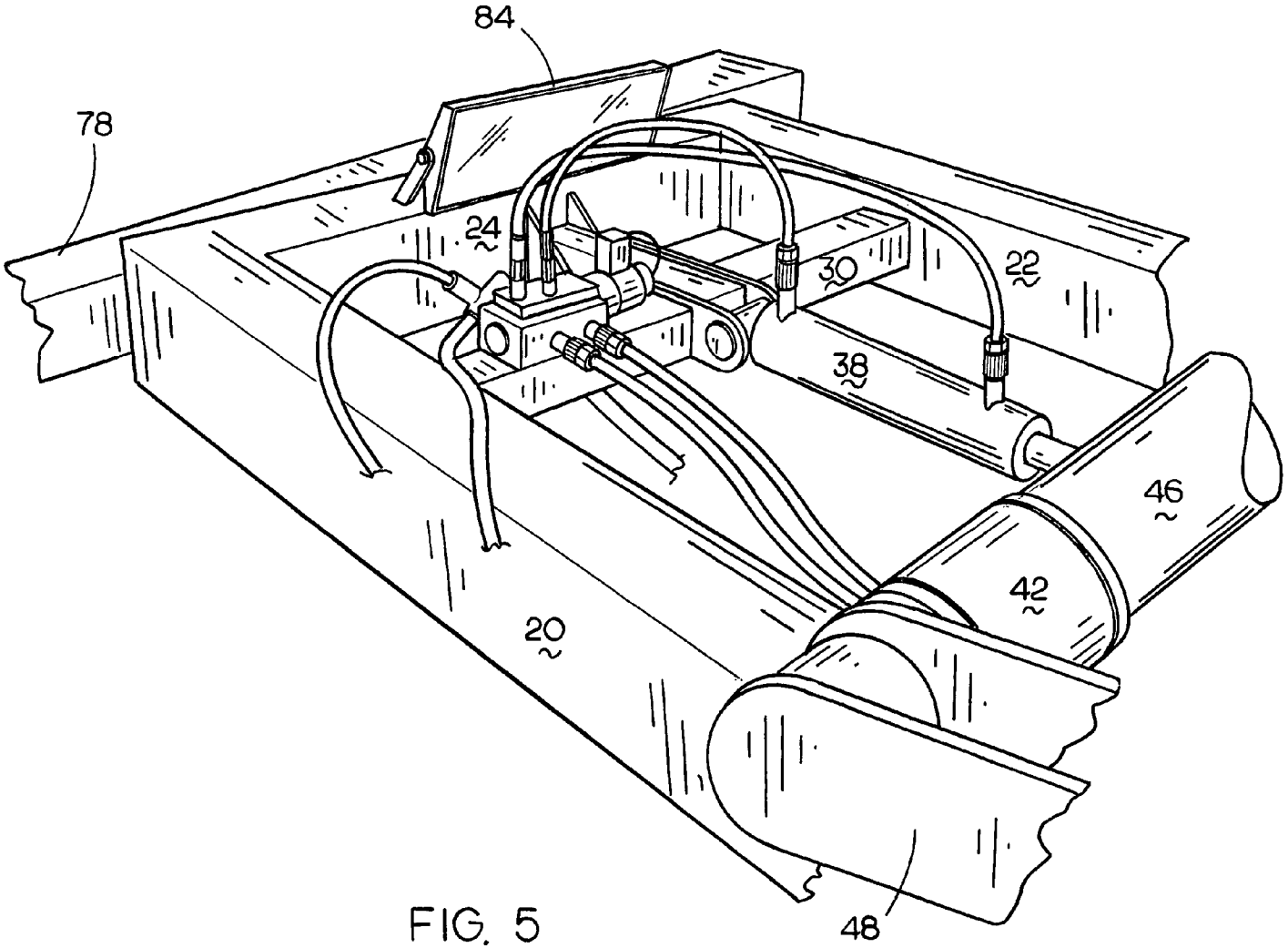
FIG. 5 is a partial rear perspective view of the invention.
Figure 6:
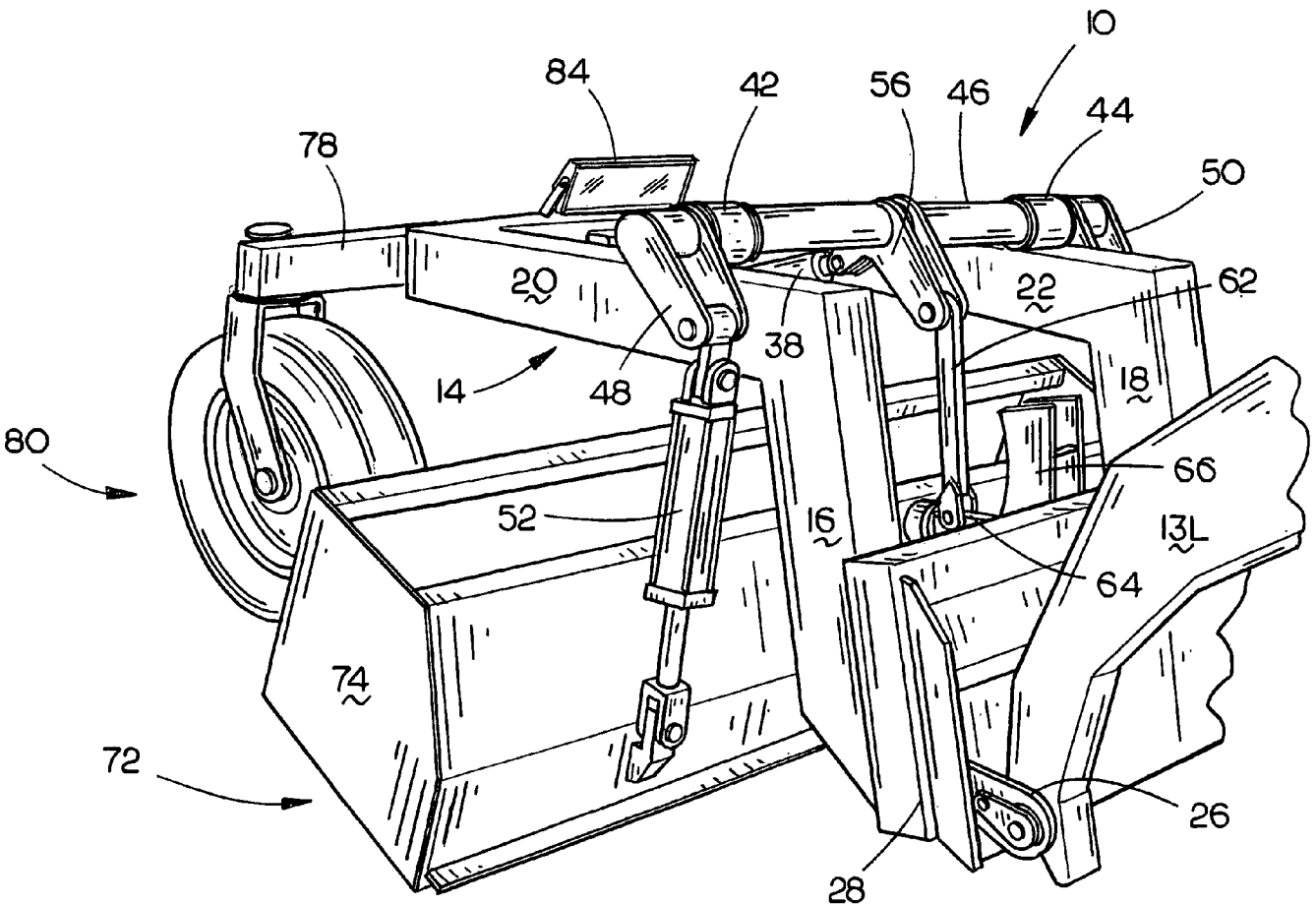
FIG. 6 is a partial rear perspective view of the invention.

Bar or link 62 is pivotally connected at its upper end to end portion 60 of bracket 56 and is pivotally connected at its lower end to the forward end of bar 64 (FIG. 2). The rearward end of bar 64 is vertically movably received in a guide or stabilizer assembly 66. The forward end of bar 64 is secured to a tube or pipe 68 upon which is rotatably mounted a larger tube or pipe 70. The forward end of tube 68 is secured to the rearward end of the angular support bar 40. A box scraper 72 having ends 74 and 76 is secured to tube 70 for rotational movement therewith and for vertical movement therewith. The rod (lower) end of hydraulic cylinder 52 is pivotally secured to the rearward side of box scraper 72 inwardly of end 74 thereof (FIG. 6). The rod (lower) end of hydraulic cylinder 54 is pivotally secured to the rearward side of box scraper 72 inwardly of end 76 thereof (FIG. 2).

The forward end of box scraper assembly 10 includes a transversely extending frame member 78 which is positioned forwardly of frame member 24 and which is pivotally or rotatably secured thereto about a longitudinal axis transverse to frame members 24 and 78. In other words, when the assembly is viewed from the front thereof, frame member 78 may pivotally move in a clockwise or counterclockwise direction with respect to frame member 24. Caster wheel assemblies 80 and 82 are mounted at the forward side of frame member 78 at the opposite ends thereof.

In operation, the box scraper assembly 10 is mounted on the forward ends of the boom arms 13R and 13L of the vehicle 12 as previously described. The castor wheel assemblies 80 and 82 will normally be in ground-engaging condition but the entire box scraper assembly 10 may be raised from the ground by the boom arms of the vehicle 12. Retraction of hydraulic cylinder 38 causes tube 46 to rotate in a counterclockwise direction, as viewed from the right of the box scraper. Retraction of hydraulic cylinder 38 causes bar 62 to be lowered which causes the box scraper to be lowered. Conversely, extension of hydraulic cylinder 38 causes the box scraper 72 to be raised with respect to the main frame.

The hydraulic cylinders 52 and 54 are cross-plumbed and connected to a source of hydraulic pressure so that when hydraulic cylinder 52 is extended, hydraulic cylinder 54 will be retracted and vice versa. Thus, the hydraulic cylinders 52 and 54 are utilized to pivot or tilt the box scraper 72 with respect to the main frame which enables the box scraper to be properly positioned to achieve the proper grade regardless of the position of the vehicle and the main frame. For example, if cylinder 52 is extended and cylinder 54 is retracted, the left end 74 of box scraper 72 will be lowered and the right end 76 of box scraper 72 will be raised. Conversely, if cylinder 52 is retracted and cylinder 54 is extended, the left end 74 of box scraper 72 will be raised and the right end 76 of box scraper 72 will be lowered.

The connection of the upper ends of the hydraulic cylinders 52 and 54 to the ends of the tube 46 through the brackets 48 and 50, respectively, results in the hydraulic cylinders 52 and 54 being moved a corresponding amount to the amount of vertical movement of the box scraper 72. As a result of the connection of the hydraulic cylinders 52 and 54 to the tube 46, the angular attitude of the box scraper 72 will not change with respect to the main frame as the box scraper 72 is raised and lowered with respect to the main frame.

For convenience, a rearwardly and downwardly facing mirror 84 is mounted on frame member 24 so that the operator of the vehicle may observe the forward end of the box scraper 72.

It can therefore be seen that the box scraper assembly of this invention accomplishes at least all of its stated objectives.

What is claimed is:

1. A box scraper assembly for attachment to the forwardly extending boom arms of a vehicle, comprising:

a main frame having a rearward end, a forward end, a right side and a left side;

said rearward end of said main frame adapted for selective removable attachment to the boom arms for vertical movement therewith;

an elongated transversely extending first frame member, having right and left sides, pivotally secured, intermediate the length of said first frame member, to said forward end of said main frame about a horizontally axis which is transverse with respect to the length of said first frame member;

a first castor wheel assembly secured to said right end of said first frame member;

a second castor wheel assembly secured to said left end of said first frame member;

a transversely extending box scraper, having a right end and a left end, selectively vertically movably mounted and selectively pivotally movably mounted on said main frame;

said box scraper being pivotally secured to said main frame about a longitudinally extending axis;

a first hydraulic cylinder secured to said box scraper adjacent said right end thereof for pivotally raising and lowering said right end of said box scraper;

a second hydraulic cylinder secured to said box scraper adjacent said left end thereof for pivotally raising and lowering said left end of said box scraper;

said first and second hydraulic cylinders being connected to a source of hydraulic pressure so that said first hydraulic cylinder is extended while said second hydraulic cylinder is being retracted and so that said first hydraulic cylinder is retracted while said second hydraulic cylinder is being extended;

said first and second hydraulic cylinders being operatively movably connected to said main frame so that the vertical movement of said box scraper with respect to said main frame does not change the relative relationship of said first and second hydraulic cylinders with respect to said right and left ends of said box scraper as said box scraper is vertically moved with respect to said main frame.

2. The assembly of claim 1 wherein said main frame includes a pair of forwardly extended second and third frame members and wherein a transversely extending tube, having a right end and a left end, is selectively rotatably mounted on said second and third frame members and extends therebetween; a third hydraulic cylinder connected to said tube for rotating said tube with respect to said second and third frame members; said tube being connected to said box scraper so that rotation of said tube in a first direction causes said box scraper to move upwardly with respect to said main frame and so that rotation of said tube in a direction opposite to said first direction causes said box scraper to move downwardly with respect to said main frame; said first and second hydraulic cylinders being connected to said right and left ends of said tube so that rotation of said tube in said first direction causes said first and second cylinders to move upwardly with respect to said main frame and so that rotation of said tube in said opposite direction causes said hydraulic cylinders to be lowered with respect to said main frame.

3. The assembly of claim 2 wherein said first and second hydraulic cylinders are vertically moved, with respect to said main frame, in the same amount as said box scraper is vertically moved with respect to said main frame.

* * * * *